US005546899A

United States Patent [19]

Sperling et al.

[11] Patent Number: 5,546,899

[45] Date of Patent: Aug. 20, 1996

[54] VALVE TRAIN LOAD TRANSFER DEVICE FOR USE WITH HYDRAULIC ROLLER LIFTERS

[75] Inventors: Kenneth R. Sperling, Granada Hills; Guy L. Tripp, Saugus, both of Calif.

[73] Assignee: Air Flow Research Heads, Inc., Pacoima, Calif.

[21] Appl. No.: 386,856

[22] Filed: Feb. 10, 1995

[51] Int. Cl.[6] ..... F01L 1/14

[52] U.S. Cl. ..... 123/90.5; 123/90.65

[58] Field of Search ..... 123/90.22, 90.48, 123/90.5, 90.61, 90.65; 74/55, 569

[56] References Cited

U.S. PATENT DOCUMENTS

| | | | |
|---|---|---|---|
| 3,021,826 | 2/1962 | Fezzy et al. | 123/90.65 |
| 3,108,580 | 10/1963 | Crane, Jr. | 123/90.5 |
| 3,124,115 | 3/1964 | Voorhies | 123/90.65 |
| 3,280,806 | 10/1966 | Iskenderian | 123/90.47 |
| 3,301,241 | 1/1967 | Iskenderian | 123/90.5 |
| 3,822,683 | 7/1974 | Clouse | 123/90.5 |
| 3,831,457 | 8/1974 | Kern | 123/90.5 |
| 5,022,356 | 6/1991 | Morel, Jr. et al. | 123/90.5 |
| 5,088,455 | 2/1992 | Moretz | 123/90.5 |
| 5,347,965 | 9/1994 | Decuir | 123/90.65 |

*Primary Examiner*—Weilun Lo
*Attorney, Agent, or Firm*—Lyon & Lyon

[57] ABSTRACT

Valve train load transfer apparatus for underhead cam push-rod engines employing hydraulic roller lifters. Auxiliary coil springs are installed between the rigid bodies of the roller lifters and the cylinder head of the engine. A binocular shaped load transfer retainer is provided for each associated pair (intake and exhaust) of valve lifters to prevent roller lifter rotation and retain associated auxiliary coil springs in engagement with the top of the lifter body. A preferably elongate bar is mounted against an underside of the cylinder head and is provided with plural flanged openings to receive the coil springs. The biasing force of the auxiliary coil springs between the receiving member and the lifter bodies holds the receiving member in position against the cylinder head.

12 Claims, 3 Drawing Sheets

VALVE TRAIN LOAD TRANSFER DEVICE FOR USE WITH HYDRAULIC ROLLER LIFTERS

BACKGROUND OF THE INVENTION

The present invention pertains generally to the field of internal combustion engines. More specifically, the present invention pertains to a load transfer device for use in pushrod engines that supplies additional overall valve train spring pressure directly to the body of a hydraulic roller lifter in engagement with a camshaft.

Internal combustion engines are typically provided with valve mechanisms to allow an air/fuel mixture to be introduced into a combustion chamber for ignition, and after combustion to allow the resultant byproducts of combustion to be exhausted from the combustion chamber. Each cylinder in an engine is typically provided with at least one intake valve and one exhaust valve which in turn are controlled by a valve train actuation mechanism that regulates the timing as well as the amount and duration of intake and exhaust valve opening and closing events.

In a typical overhead valve engine, the valve stem of each individual valve (intake and exhaust) is positively engaged and biased in an upward direction by a compressed coil spring positioned over the valve stem. This spring arrangement causes a constant upward spring bias on the valve stem and forces the valve face or head at the opposite end of the valve into sealing engagement with a corresponding valve seat formed in a engine cylinder head. In this manner, the valve spring bias maintains the valve in a normally closed position.

In an underhead cam pushrod engine the valves are actuated by pivotally mounted rocker arms that engage the top of the valve stems on one end and which are engaged by pushrods on the opposite end. The pushrods are engaged by valve lifters or tappets which reciprocate within bores formed in the engine block. As the valve lifter rides upward on a camshaft lobe, the upward motion of the pushrod on the rocker arm forces the valve stem downward against the spring pressure of the main valve spring and causes the valve face to separate from the valve seat and move to an open position. This allows the combustion chamber to be either charged, in the case of an intake valve, or purged after the power stroke in the case of an exhaust valve.

As the camshaft rotates, the individual camshaft lobes rotate under the valve lifters to control upward and downward pushrod motion and ultimately, through the rocker arms, the valve opening and closing events. It can be appreciated from this arrangement that as a camshaft lobe rotates past the associated valve lifter that the valve spring pressure will force the pushrod (through the rocker arm), and associated valve lifter downward following the profile of the camshaft to allow the valve to return to a closed position.

The opening and closing events of the valve train are critical in determining the overall performance of any given engine. In order to maintain proper valve timing, the valve springs must be of large enough spring force to maintain the lifter body in constant contact with the rotating camshaft over the entire operating range of the engine. When the valve return spring pressure is not great enough, lifter separation occurs and uncontrolled valve train motion may result. This condition, commonly known as lifter or valve float, can result in the loss of engine power as well as the possibility of parts breakage.

It is desirable in many high performance and racing applications to operate at elevated engine revolutions per minute ("r.p.m.") levels to obtain increased power output, as engine horsepower increases are proportional to increases in r.p.m.'s. However, at elevated engine r.p.m. levels the problem of lifter separation becomes particularly acute in that the valve lifter begins to have difficulty accurately following the camshaft profile.

The ability of the valve lifter to accurately follow the camshaft profile is normally dictated by valve spring pressure, with larger valve spring pressures providing the capability of higher permissible rpm ranges without incurring uncontrolled valve train motion. Unfortunately, because the pushrod engages the interior of the valve lifter through a relatively small contact portion, the amount of spring pressure that can be exerted on the interior of the valve lifter is extremely limited. Exceeding valve return spring pressure specifications may result in the collapse of the interior mechanism of the lifter as well as the possibility of bending the pushrods, in either case, causing severe engine damage.

Performance enhancement devices variously known as helper springs or "rev kits" have been developed by aftermarket manufacturers to safely provide increased valve train stability at high r.p.m. levels for racing and high performance applications. An example of a simple helper spring is illustrated in U.S. Pat. No. 3,280,806 to Iskenderian. In this patent, a helper spring in the shape of a bail is positioned between the rocker arm and the base of the main valve spring to independently maintain the rocker arm assembly in pressure contact with the camshaft. The helper spring thus relieves the main valve spring of the burden of maintaining lifter contact with the camshaft, and allows the main valve spring to simply provide the necessary return pressure to close the valve. However, the helper spring in this patent is not designed to increase the overall valve train spring pressure or ultimate force to be applied to the valve lifter to permit high r.p.m. operation. Moreover, there is no load transfer from the pushrod to the lifter body since the spring pressure is applied to the rocker arm by the helper spring and undesirably transmitted through the pushrod to the internal mechanism of the lifter body in the same manner as the force from the main valve spring.

A more desirable known approach involves transferring spring pressure away from the pushrods and their small internal contact point inside the lifter to the lifter body which is completely rigid and therefore capable of tolerating much greater spring pressures than the internal lifter mechanism. Such increased spring pressures enable the use of much more aggressive opening and closing valve rates with respect to camshaft profiles thus enabling the engine to produce even greater r.p.m. and horse power levels. Examples of state of the art valve train spring load transfer devices are commercially known as the "Ultra Rev Kit" marketed by Isky Racing Cams and the "Rev Kit for Harley Davidson" marketed by Fueling R & D.

Roller valve lifters are another performance enhancement device commonly employed in high performance engine application. These lifters have roller bearings at the end of the lifter that rides on the rotating camshaft. The use of roller lifters is desirable as their rolling contact surface reduces lifter/camshaft friction resulting in improvements in power output as well as reductions in fuel consumption. In recognition of these improvements, roller valve lifters have been used by the racing community and by high performance engine builders for many years to obtain increased engine power output. Moreover, several major auto manufacturers have recently started supplying engines with hydraulic roller valve lifters directly from the factory to squeeze additional efficiency and power output from their engines. Examples of roller lifter assemblies are given in U.S. Pat. No. 3,301,241 to Iskenderian and in U.S. Pat. No. 3,108,580 to Crane.

Unlike conventional valve lifters, roller valve lifters must be prevented from rotating as they reciprocate in the engine bore so that the roller bearing on the roller lifter is maintained in correct alignment with the contacting surface of the camshaft. One technique for preventing roller lifter rotation involves "ganging" adjacent lifters together through use of an appropriate alignment bar affixed to adjacent lifters. Another known anti-rotation technique uses an appropriate retainer that is installed over the top of adjacent lifter bodies, and which has flat sides that mate with corresponding flat sides in the lifter body to prevent rotation.

Despite the prevalent use of hydraulic roller lifters there are presently no known load transfer devices that can be used with these lifters. The known roller lifter anti-rotation means are not compatible with existing load transfer devices such as the devices sold by Iskenderian and Fueling noted above. Accordingly, it would be desirable to provide a valve train load transfer apparatus that works with hydraulic roller lifters to supply increased valve train spring pressure directly to the rigid body of the roller lifters.

SUMMARY OF THE INVENTION

According to the present invention a valve train load transfer apparatus is provided that permits increased r.p.m. ranges and engine power output in overhead valve pushrod engines employing hydraulic roller valve lifters. Uncontrolled valve train motion at high r.p.m. is minimized by increasing overall valve train spring pressure through the use of auxiliary coil springs that apply additional spring pressure directly to the rigid body of the hydraulic roller lifters.

In a preferred embodiment, a valve train load transfer apparatus comprises a load transfer retainer receivable on adjacent pairs of hydraulic roller lifters that includes a biasing force retention member for each roller lifter and an anti-rotation member to prevent rotation of the lifters as they reciprocate within an engine bore; auxiliary coil springs for use between the rigid bodies of roller lifters and a cylinder head of the engine; and preferably, a coil spring receiving member that may comprise an elongate bar for mounting on the underside of a cylinder head and having plural flanged openings for receiving auxiliary coil springs. The biasing force of the auxiliary coil springs between the lifter bodies and the receiving member preferably holds the receiving member in position against the cylinder head.

A preferred load transfer retainer comprises an integral binocular shaped alignment tool for each adjacent pair (intake and exhaust) of valve lifters that gangs adjacent roller lifters together to prevent lifter rotation, and provides retention means for the associated auxiliary coil springs.

The present invention advantageously allows additional valve train spring pressure to be applied directly to the rigid external shell of the roller lifter rather than through the pushrods to the more fragile internal lifter mechanism as would be the case were larger main valve springs to be substituted for use of the present invention. Thus, increased valve train stability at high r.p.m. levels is achieved by applying spring pressure to where it is best able to be withstood without causing engine damage.

BRIEF DESCRIPTION OF THE DRAWINGS

Reference is made to the accompanying drawings, in which like reference numerals indicate like parts, and in which are shown illustrative embodiments of the invention from which its novel features and advantages will be apparent to those of ordinary skill in the art.

DETAILED DESCRIPTION OF THE PREFERRED EMBODIMENT

Figure 1A:
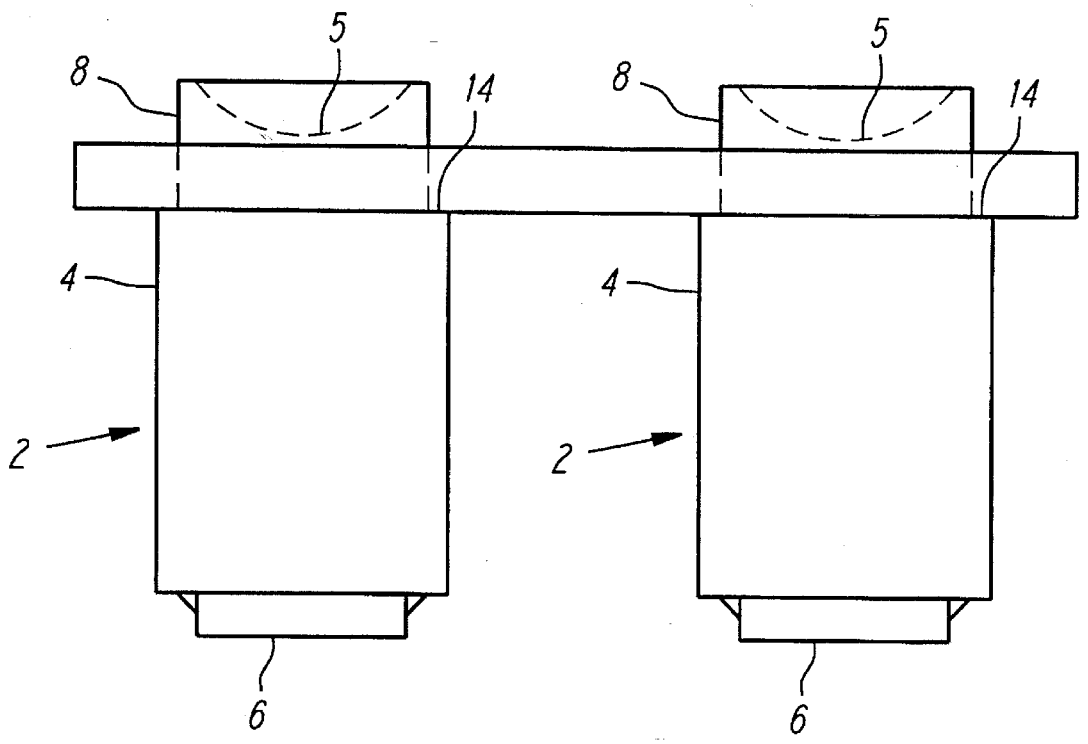
FIG. 1A (PRIOR ART)
FIGS. 1A and B are respectively side and top plan views of prior art hydraulic roller lifters with an associated anti-rotation member.
Figure 1B:
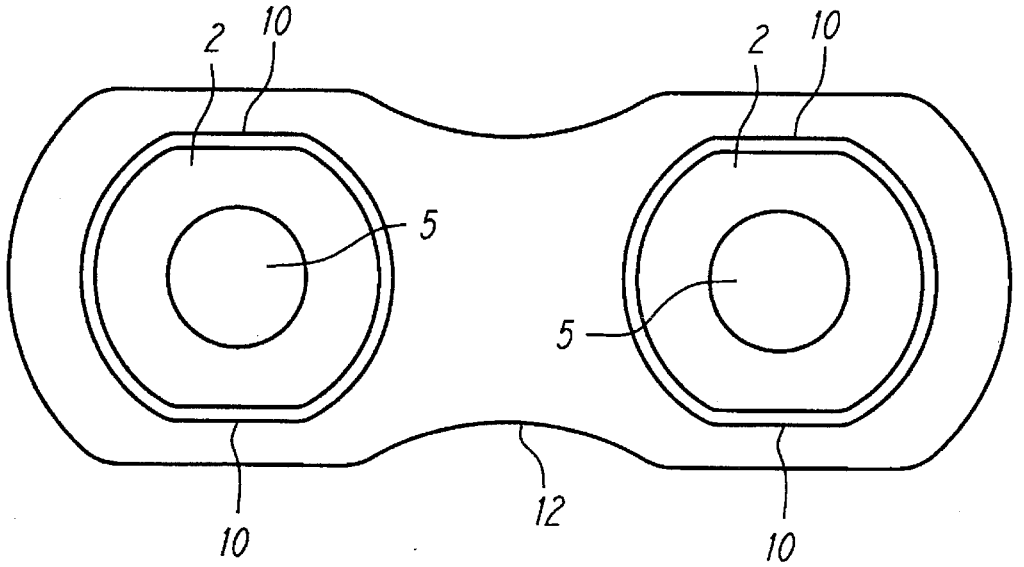
FIG. 1B (PRIOR ART)

A pair of prior art hydraulic roller lifters 2 that may be used with the valve train load transfer apparatus of the present invention are illustrated in FIGS. 1A and B. The roller lifters 2 have a hollow cylindrical body 4 with a lower end that receives a roller bearing 6 that is engaged by a camshaft, and an internal hydraulic piston mechanism (not shown) that has an internal cup 5 to accept and engage a conventional push rod at its upper end 8. The top of the external body 4 of each roller lifter 2 has a pair of opposing flat sides 10 designed to receive corresponding flat sides formed on retainer 12. The retainer 12 is installed over the top of adjacent roller lifters 2 to prevent them from rotating as they reciprocate in an engine bore. The lifters have a shoulder 14 that provides a stop to limit the movement of the retainer 12.

Figure 2A:
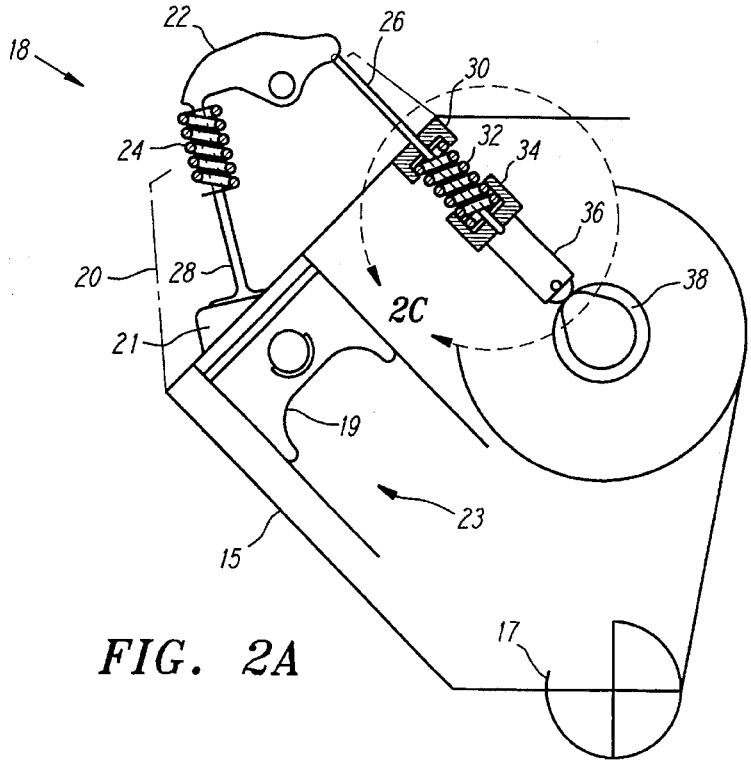
FIG. 2A is a partial cross-sectional view of a valve train load transfer apparatus according to the present invention installed in a conventional underhead cam pushrod engine.
Figure 2B:
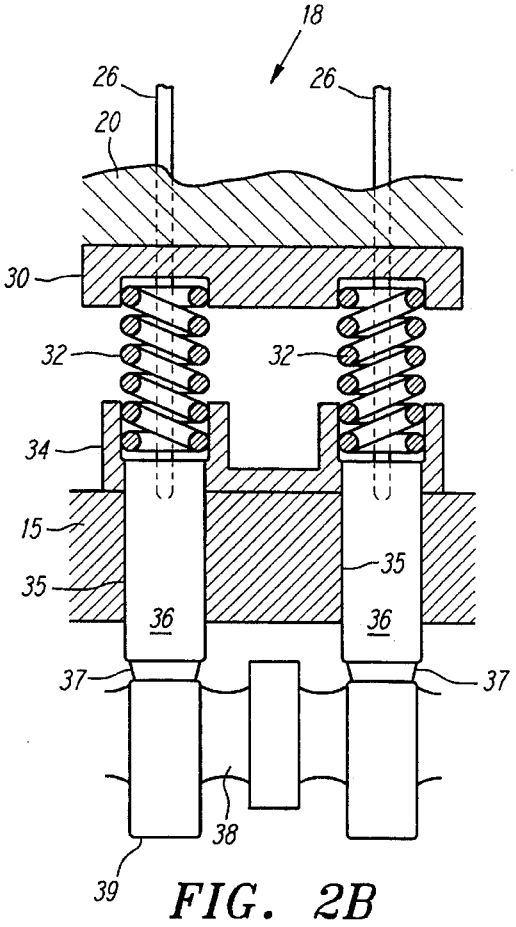
FIG. 2B is a cross-sectional view of the area of detail from FIG. 2A illustrating features and aspects of the present invention.
Figure 2C:
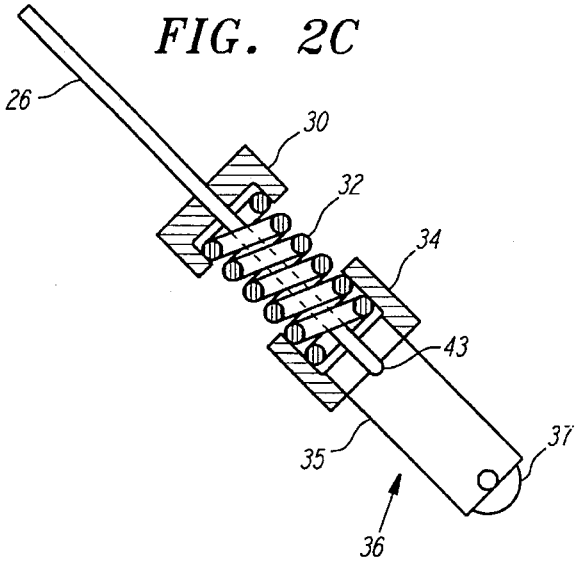
FIG. 2C is an end view of a load transfer apparatus illustrated removed from its surrounding engine environment.

With reference to FIGS. 2A–C, an embodiment of a preferred valve train load transfer apparatus will now be described. A conventional internal combustion engine 18 has one or more pistons 19 that reciprocate within a cylinder bore 23 formed in an engine block 15. The pistons 19 are connected to a rotating crankshaft 17 by conventional means. Valves 28 are provided in a cylinder head 20 that is mounted on the top of engine block 15. As is conventional in a underhead cam pushrod engine, each cylinder 23 has two adjacent valves 28 (intake and exhaust) that alternately open and close to charge and discharge combustion chamber 21. Although the inventor is presently unaware of any pushrod engines that have more than two valves per cylinder, the teachings disclosed herein are equally applicable to such a combination, and hence are within the contemplation of the present invention.

Main valve springs 24 preferably bias the valves 28 in a normally closed position, such that their valve face mates in sealing engagement with a corresponding valve seat formed in the underside of cylinder head 20. The valves are actuated by pivotally mounted rocker arms 22 that engage the top of the stems of valves 28. Upward movement of the pushrods 26 is multiplied in a constant amount by the rocker arms as they pivot to open the valves 28 against the biasing force of the main valve springs 24. The pushrods are in turn actuated by the combination of rotating camshaft 38 and hydraulic roller lifters 36.

The roller lifters 36 may have a conventional internal hydraulic piston mechanism inside their rigid cylindrical body 35 that is provided with a cup (43 in FIG. 3B) to receive and engage the lower ends of pushrods 26. Roller bearings 37 in the lower ends of roller lifters 36 ride on the outer bearing surface of camshaft 38. The roller lifters are reciprocated within bores in the engine block 15 as the lifters rise and fall on the camshaft lobes that rotate underneath. This rotation in combination with valve train return spring pressure alternately raises and lowers the lifters 36 causing the associated valves 28 to alternately open and close.

To provide increased valve train stability in high r.p.m. applications a valve train load transfer apparatus is installed between the cylinder head and engine block as shown in FIGS. 2A–C.

In a preferred embodiment, a load transfer apparatus comprises receiving member 30, auxiliary coil springs 32 and load transfer retainer 34. Auxiliary coil springs 32 are installed in a compressed state between receiving member 30 and the lifter bodies 35 with pushrods 32 passing through the center of the coil springs 32 to engage the internal piston mechanism of the roller lifters 36. The auxiliary coil springs 32 apply additional valve train spring pressure directly to the rigid lifter bodies 35 to assist in maintaining the lifters 36 in constant engagement with the bearing surface of the camshaft 38. The pressure of the auxiliary springs 32 may vary according to the application and the specific engine as well as the valve train components, e.g., camshaft and main valve springs, utilized in conjunction with the load transfer apparatus.

Figure 2D:
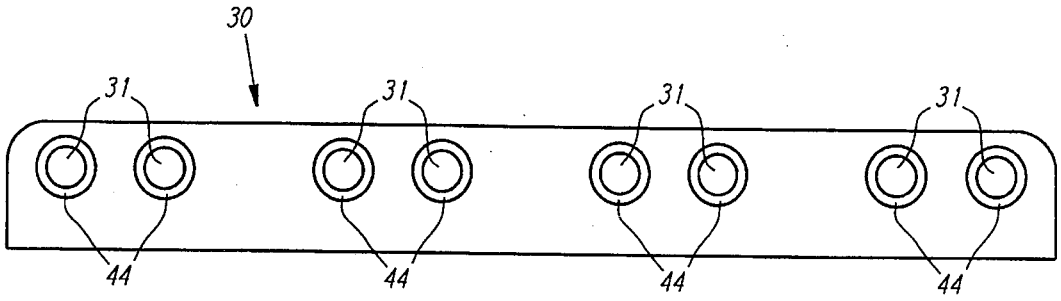
FIG. 2D is a plan view of a receiving member for use in a V-8 engine in accordance with the present invention.

The receiving member 30, which may comprise an elongate bar made of a suitable material such as steel or preferably aluminum, is disposed on the underside of cylinder head 20 and preferably mates against the cylinder head wall. A receiving member 30 designed for use on one side of a conventional two valve per cylinder V-8 engine (or an in-line four cylinder engine) is illustrated in FIG. 2D. The receiving member 30 preferably has plural openings 31 provided with inner flanges or lips 44 that receive one end of auxiliary coil springs 32. The pushrods 32 pass unobstructed through the center of openings 31 formed in the receiving member 30. The biasing force of the compressed coil springs 32 preferably retains the receiving member 30 in position against the underside of the cylinder head 20.

It can be appreciated that the number of coil spring receiving flanged openings 31 formed in receiving member 30 will correspond to the number of valves 28 contained in the particular cylinder head 20 that is utilized. Further, the receiving member 30 may take on a wide variety of shapes and configurations depending on the design of the particular cylinder head and the engine configuration e.g., V-4, V-6, etc. it is used in, to enable the receiving member 30 to fit into the available space on the underside of the cylinder head 20.

As best illustrated in FIGS. 2B and C, a preferably binocular shaped load transfer retainer 34 formed of a suitable material such as steel, for example, is installed over the top of adjacent roller lifters 36 (intake and exhaust) to prevent roller lifter 36 rotation and to retain the auxiliary coil springs 32 in engagement with the top of the lifter bodies 35. The tops of roller lifters remain at all times partially exposed above engine block 15, and pass partially through the load transfer retainer 34. Sufficient clearance is provided between load transfer retainer 34 and the roller lifters 36 to permit a full range of roller lifter 36 motion as they are reciprocated within their respective engine bores.

Figure 3A:
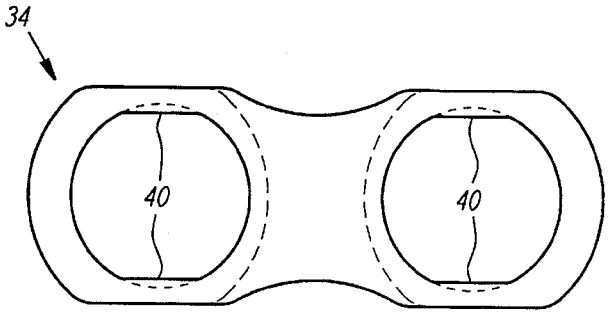
FIG. 3A is a bottom view of a load transfer retainer that comprises one aspect of the present invention.
Figure 3B:
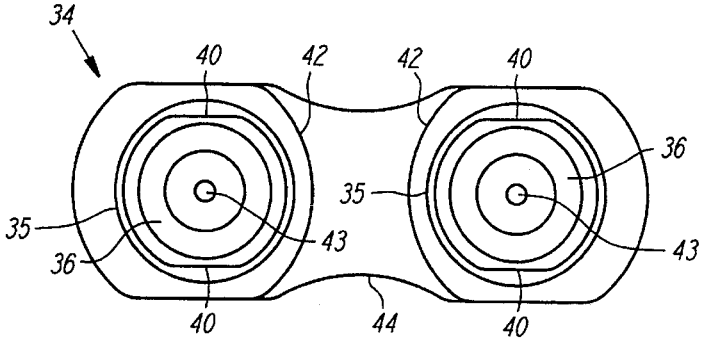
FIG. 3B is a plan view of a load transfer retainer according to the invention installed over a pair of adjacent roller lifters.
Figure 3C:
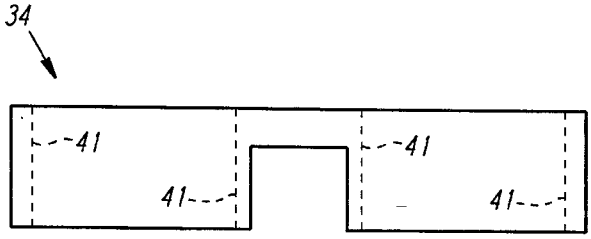
FIG. 3C is a side view of a load transfer retainer illustrating the wall thickness of a preferred embodiment.
Figure 3D:
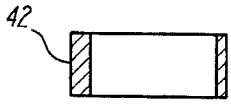
FIG. 3D is a cross-sectional view of a biasing force retaining member shown separated from a load transfer retainer.

Turning now to FIGS. 3A–D, a preferred load transfer retainer 34 comprises anti-rotation member 44 and biasing force retention members 42. In a preferred embodiment, biasing force retention members may comprise cylindrical rings 42 with a wall thickness as illustrated by dashed lines 41 in FIG. 3C. Anti-rotation member 44 has a pair of openings with opposing flat sides 40 that mate with corresponding flat sides formed in lifter bodies 35 when the anti-rotation member is installed over adjacent pairs of roller lifters 36. Cylindrical rings 42 preferably guide and retain auxiliary springs 32 in contact with the upper lip of the lifters 36 that pass partially therethrough. The rings 42 are preferably formed as an integral part of a load transfer retainer 34 but may be formed as separate members as illustrated in FIG. 3D. As shown in FIG. 3B, sufficient clearance is provided between the lifter bodies 35 and the annular portions of the anti-rotation member and the cylindrical rings to minimize unnecessary parts contact.

The performance gains made possible through the use of a valve train load transfer apparatus as disclosed herein are substantial. The performance gains before and after installation of a valve train load transfer apparatus are illustrated in the following table comparing the output of a Chevrolet small-block V-8 engine employing hydraulic roller lifters:

| RPMS | TORQUE (ft-lb) | HORSEPOWER |
|---|---|---|
| BASELINE PERFORMANCE | | |
| 6000 | 279.4 | 319.2 |
| 6500 | 184.4 | 228.2 |
| PERFORMANCE AFTER INSTALLATION OF LOAD TRANSFER APPARATUS | | |
| 6000 | 319.2 | 364.7 |
| 6500 | 252.0 | 311.9 |

As can be seen, installation of the load transfer apparatus resulted in increases in both torque and horsepower over baseline performance levels (39.8 ft-lbs. of torque and 45.5 hp @ 6000 r.p.m., and 67.6 ft-lbs. of torque and 83.7 hp @ 6500) for this particular engine.

While embodiments and applications of this device have been shown and described, it would be apparent to those skilled in the art that many more modifications are possible without departing from the inventive concepts disclosed herein. The invention, therefore is not to be restricted except in the spirit of the following claims.

We claim:

1. A valve train load transfer apparatus for use with hydraulic roller lifters in an internal combustion engine, each of the roller lifters having a rigid cylindrical body with an open upper end, said load transfer apparatus comprising:

an auxiliary coil spring inserted between the open end of each lifter body and a cylinder head of the engine; and a load transfer retainer receivable on adjacent pairs of hydraulic roller lifters, said load transfer retainer comprising a biasing force retaining member for each lifter to retain said auxiliary coil springs in engagement with the open ends of the lifter bodies; and an anti-rotation member for ganging said roller lifters together to prevent said roller lifters from rotating.

2. The valve train load transfer apparatus of claim 1 further comprising an auxiliary coil spring receiving member mounted beneath said cylinder head, said receiving member including a plurality of flanged openings that receive said auxiliary coil springs.

3. The valve train load transfer apparatus of claim 2 wherein said auxiliary coil spring receiving member comprises an elongate bar.

4. The valve train load transfer apparatus of claim 1 wherein said anti-rotation member has a pair of oblate openings with opposing flat sides that mate with corresponding flat sides formed on the roller lifter bodies which said load transfer retainer is received on, and wherein said biasing force retaining members comprise cylindrical rings.

5. The valve train load transfer apparatus of claim 4 wherein said cylindrical rings are formed as an integral part of said anti-rotation member.

6. A load transfer retainer for use with hydraulic roller lifters in an internal combustion engine, the roller lifters of the type having a cylindrical body with opposing flat sides formed on an open upper end of the body, the load transfer retainer comprising:

an anti-rotation member comprising a pair of oblate openings with opposing flat sides that mate with corresponding flat sides of adjacent lifters as the lifters pass through said anti-rotation member to prevent the lifters from rotating; and a pair of biasing force retaining members received on said anti-rotation member for retaining coil springs inserted between a cylinder head of the engine and the upper end of the lifter bodies in engagement with the open upper end of adjacent lifter bodies as the lifters reciprocate within an engine bore.

7. The load transfer retainer of claim 6 wherein said biasing force retaining members comprise cylindrical rings.

8. The load transfer retainer of claim 7 wherein said cylindrical rings are formed as an integral part of said anti-rotation member.

9. A valve train load transfer apparatus for use in an internal combustion engine that employs hydraulic roller lifters having a rigid cylindrical body with an open upper end, said load transfer apparatus comprising:

an auxiliary coil spring inserted into the open upper end of the body of each hydraulic roller lifter to be serviced;

a load transfer retainer receivable on adjacent pairs of hydraulic roller lifters comprising a biasing force retaining member for retaining said auxiliary coil springs in engagement with the open end of the lifter bodies as the roller lifters reciprocate within bores formed in the engine; and an anti-rotation member, said anti-rotation member for joining adjacent lifter pairs together to prevent rotation; and a receiving member inserted into the engine so that it mates against a cylinder head of the engine, said receiving member including a plurality of flanged openings for receiving the other end of each of said auxiliary coil springs.

10. The valve train load transfer apparatus of claim 9 wherein said anti-rotation member has a pair of oblate openings with opposing flat sides that mate with corresponding flat sides formed on the open end of the roller lifters bodies that said load transfer retainer is received on, and wherein said biasing force retaining members comprise cylindrical rings.

11. The valve train load transfer apparatus of claim 10 wherein said anti-rotation member and said cylindrical rings comprise an integral unit.

12. The valve train load transfer apparatus of claim 9 wherein said receiving member comprises an elongate bar.

* * * * *